US012291840B2

(12) United States Patent
Vandegrift et al.

(10) Patent No.: US 12,291,840 B2
(45) Date of Patent: May 6, 2025

(54) SYSTEM AND METHOD OF AUTOMATED SETTING OF ELEVATION REFERENCE FOR CONTINUOUS GRADE CONTROL

(71) Applicant: Deere & Company, Moline, IL (US)

(72) Inventors: Alex R. Vandegrift, Davenport, IA (US); Bryan D. Sulzer, Dubuque, IA (US); Bryan J. Rausch, Durango, IA (US)

(73) Assignee: Deere &Company, Moline, IL (US)

( * ) Notice: Subject to any disclaimer, the term of this patent is extended or adjusted under 35 U.S.C. 154(b) by 195 days.

(21) Appl. No.: 18/159,517

(22) Filed: Jan. 25, 2023

(65) Prior Publication Data

US 2024/0247462 A1 Jul. 25, 2024

(51) Int. Cl.
*E02F 3/43* (2006.01)
*E02F 3/32* (2006.01)
*E02F 9/26* (2006.01)

(52) U.S. Cl.
CPC ..... *E02F 3/439* (2013.01); *E02F 9/262* (2013.01); *E02F 3/32* (2013.01)

(58) Field of Classification Search
CPC ... E02F 3/439; E02F 9/262; E02F 3/32; E02F 9/205; E02F 3/437
See application file for complete search history.

(56) References Cited

U.S. PATENT DOCUMENTS 4,111,066 A 9/1978 Kendrick
4,945,221 A 7/1990 Nielsen et al.
5,493,798 A 2/1996 Rocke et al.
5,631,658 A * 5/1997 Gudat ..... E01C 19/004 701/1
6,247,538 B1 6/2001 Takeda et al.
(Continued)

FOREIGN PATENT DOCUMENTS

DE 112012006937 T5 6/2015
DE 112016000156 T5 8/2017
(Continued)

OTHER PUBLICATIONS

German Search Report issued in application No. 102023135761.1 dated Jul. 23, 2024, 08 pages.
(Continued)

*Primary Examiner* — Tyler J Lee
(74) *Attorney, Agent, or Firm* — Gary L. Montle; Lucian Wayne Beavers; Patterson Intellectual Property Law, PC

(57) ABSTRACT

An auto-benching grade control system and method are provided for work machines such as excavators. Movements of at least one implement relative to a machine frame are actuated based on user inputs via a first user interface tool. Manual/automatic control modes are selected based on user inputs via a second user interface tool. Responsive to further user input via at least one of the first and second user interface tools, a target elevation is automatically specified based on a current elevation of at least one implement component corresponding to the further user input. During the automatic control mode, movement of at least the implement is controlled based at least in part on a specified target mainfall and a specified target cross-slope for at least a portion of the terrain to be worked, and the specified target elevation.

14 Claims, 3 Drawing Sheets

(56) References Cited

U.S. PATENT DOCUMENTS

| | | | | |
|---|---|---|---|---|
| 6,477,914 | B1 | 11/2002 | Krieger | |
| 6,736,216 | B2 | 5/2004 | Savard et al. | |
| 7,477,973 | B2 | 1/2009 | Brewer et al. | |
| 7,934,329 | B2 | 5/2011 | Mintah et al. | |
| 8,141,650 | B2 | 3/2012 | Breiner et al. | |
| 8,180,532 | B2 | 5/2012 | O'Halloran et al. | |
| 8,634,991 | B2 | 1/2014 | Douglas | |
| 8,689,471 | B2 | 4/2014 | Carpenter et al. | |
| 8,919,455 | B2 | 12/2014 | Hendron et al. | |
| 9,074,546 | B2 | 7/2015 | Asami et al. | |
| 9,187,879 | B2 | 11/2015 | Suk | |
| 9,234,329 | B2 | 1/2016 | Jaliwala et al. | |
| 9,328,479 | B1 | 5/2016 | Rausch et al. | |
| 9,428,885 | B2 | 8/2016 | Nau | |
| 9,551,115 | B2 | 1/2017 | Engels et al. | |
| 9,551,130 | B2 | 1/2017 | Hendron et al. | |
| 9,624,643 | B2 | 4/2017 | Hendron et al. | |
| 9,638,525 | B1 | 5/2017 | Willis | |
| 9,976,285 | B2 | 5/2018 | Padilla | |
| 9,995,016 | B1 | 6/2018 | Howell et al. | |
| 10,094,654 | B2 | 10/2018 | Crozier et al. | |
| 10,401,176 | B2 | 9/2019 | Nackers et al. | |
| 10,532,741 | B2 | 1/2020 | Kean et al. | |
| 10,704,233 | B2 | 7/2020 | Dusha | |
| 10,883,248 | B2 | 1/2021 | Stotlar | |
| 11,414,839 | B2 | 8/2022 | Shintani et al. | |
| 11,873,617 | B2 * | 1/2024 | Koenig | E02F 3/7618 |
| 11,898,321 | B2 * | 2/2024 | Kalantar | E02F 9/265 |
| 2008/0047170 | A1 | 2/2008 | Nichols | |
| 2011/0311342 | A1 | 12/2011 | Montgomery | |
| 2013/0080112 | A1 | 3/2013 | Friend | |
| 2013/0103247 | A1 | 4/2013 | Ogawa et al. | |
| 2014/0168009 | A1 | 6/2014 | Peake | |
| 2014/0343800 | A1 | 11/2014 | Nelson et al. | |
| 2016/0003171 | A1 | 1/2016 | Ge | |
| 2016/0258128 | A1 | 9/2016 | Nakamura et al. | |
| 2017/0218594 | A1 | 8/2017 | Padilla | |
| 2019/0100205 | A1 | 4/2019 | Kean et al. | |
| 2019/0226176 | A1 * | 7/2019 | Smith | E02F 3/432 |
| 2019/0234045 | A1 * | 8/2019 | Wiewel | E02F 9/2029 |
| 2020/0042023 | A1 | 2/2020 | Garvin et al. | |
| 2020/0325650 | A1 * | 10/2020 | Tsukamoto | E02F 9/205 |
| 2021/0108378 | A1 * | 4/2021 | Green | E01C 19/48 |
| 2021/0189667 | A1 | 6/2021 | Fritz | |
| 2021/0340735 | A1 * | 11/2021 | Veasy | E02F 3/7631 |
| 2022/0170234 | A1 | 6/2022 | Nakano et al. | |
| 2022/0195693 | A1 * | 6/2022 | Kalantar | E02F 3/845 |
| 2022/0243423 | A1 * | 8/2022 | Koenig | E02F 3/7613 |

FOREIGN PATENT DOCUMENTS

| | | | |
|---|---|---|---|
| DE | 112015000236 | B4 | 7/2018 |
| DE | 102019219174 | A1 | 6/2020 |
| DE | 102021208677 | A1 | 3/2022 |
| JP | 2018145925 | A | 9/2018 |
| WO | 2008129345 | A1 | 10/2008 |
| WO | 2012157381 | A1 | 11/2012 |

OTHER PUBLICATIONS

Cat® Grade Control for Hydraulic Excavators Depth and Slope Operating Guide, 4 pages, 2012 publication.

* cited by examiner

SYSTEM AND METHOD OF AUTOMATED SETTING OF ELEVATION REFERENCE FOR CONTINUOUS GRADE CONTROL

FIELD OF THE DISCLOSURE

The present disclosure relates generally to work machines such as excavators having grade control systems that automatically grade to an elevation reference, and more particularly to techniques for automatically setting such elevation references without for example requiring conventional benching with each grading pass.

BACKGROUND

Work machines within the scope of the present disclosure may for example include not only hydraulic excavators but loaders, crawlers, motor graders, backhoes, forestry machines, front shovel machines, and others. These work machines may typically have wheeled or tracked ground engaging units supporting a frame and/or undercarriage from the ground surface, but work machines within the scope of the present disclosure may also include stationary frames with one or more components moveable relative thereto. Work machines as disclosed herein may include for example a work implement, which includes one or more components, that is used to modify the terrain based on control signals from and/or in coordination with movement of the work machine.

In the particular context of grade control applications, such systems may be generally split into two broad categories. Two-dimensional grade control is where the work machine is expected to cut a surface in one direction. The two dimensions controlled by the grade control system are the depth of cut and the slope of cut. Three-dimensional grade control is used when the grade control system needs to cut a compound slope or in situations where lateral positioning of the work machine is important. Three-dimensional applications typically require either a GNSS antenna or a robotic surveying station in addition to all of the other sensors required for a two-dimensional grade control application. One of the conventional challenges in two-dimensional grading applications is how to maintain a common elevation as the ground engaging units of the work machine are moved. The three-dimensional grade control system uses its external reference system to accomplish this, whereas two-dimensional systems often require a common touch point before and after moving the ground engaging units or the use of a laser plane.

When using a laser plane, the grade control system may determine the depth of the desired surface from the laser plane. A sensor such as a conventional laser receiver, for example on the arm of an excavator as the work machine at issue, senses the laser and corrects for any change in vertical reference due to track motion. When the laser plane is sloped, the work machine is able to cut a sloped surface. However, this requires the work machine to be oriented either in parallel or perpendicular with respect to the slope of the laser plane. If the work machine is misaligned, the slope it cuts will not be parallel to the laser plane, since the grade control system does not know how to orient its internal slope command relative to the elevation of the laser plane and can only adjust the depth of cut.

2D/Basic Grade Control on an excavator platform allows operators to grade to a target surface mainfall, cross-slope and elevation from a known benchmark. The operator has to setup these three parameters in initial setup and then move the excavator bucket to a known elevation and press a button to bench mark the current implement elevation to establish their design surface elevation relative to the machine platform, typically for each grading pass.

BRIEF SUMMARY

The current disclosure provides an enhancement to conventional systems, at least in part by introducing a novel "auto-benching" grade control system and method for elevation setup that does not require conventional benching on an excavator platform. In other words, a system as disclosed herein automatically may grade to the mainfall and cross-slope defined at any point the operator intends to grade without having to bench to establish elevation. The system may for example recognize a predetermined work state, such as when the operator is attempting to grade and is commanding arm in or out, and then controls the boom and/or bucket to maintain the desired grade surface from that starting (reference) elevation. This may be achieved by auto-benching when the arm was commanded in and the boom no longer has any operator input while in a digging configuration, or alternatively the system may be configured or otherwise triggered to auto-bench once the operator presses the auto button in the press-and-hold button grade control method.

These features may enable newer operators to grade cleanly without the complication or slowdown of benching for each pass. These features may further enable experienced operators to run grade control quicker without having to bench for a grading pass.

In one particular and exemplary embodiment, a method is disclosed herein for operating a work machine comprising a machine frame and at least one implement for working a terrain. The method comprises specifying at least a target surface mainfall and a target cross-slope for at least a portion of the terrain to be worked, actuating movements of the at least one implement relative to the machine frame based at least in part on user inputs via a first user interface tool, and switching between a manual control mode and an automatic control mode based at least in part on user inputs via a second user interface tool. Responsive to a predetermined user input via at least one of the first and the second user interface tool, the method includes further automatically specifying a target elevation based on a current elevation of at least one component of the at least one implement corresponding to the further user input, and during the automatic control mode, controlling movement of at least the at least one implement for working the terrain based at least in part on the specified target mainfall, the specified target cross-slope, and the specified target elevation.

In one exemplary aspect according to the above-referenced method embodiment, a specified work state for the work machine is detected, wherein the target elevation is specified responsive to the specified work state and the further user input.

In another exemplary aspect according to the above-referenced method embodiment and optional aspects thereof, a transition to the specified work state for the machine is detected, wherein the target elevation is specified responsive to the detected transition and the further user input.

In another exemplary aspect according to the above-referenced method embodiment and optional aspects thereof, detection of the specified work state is based on a comparison of received user inputs via the first interface tool with respect to stored combinations and/or sequences of user inputs via the first interface tool and classified into different predetermined work states.

In another exemplary aspect according to the above-referenced method embodiment and optional aspects thereof, the work machine may be an excavator, wherein the specified work state corresponds to a digging work state, the at least one implement comprises a boom, an arm, and a bucket, and the target elevation is specified responsive to a cessation of user input via the first user interface tool commanding the arm inward.

In another exemplary aspect according to the above-referenced method embodiment and optional aspects thereof, during the automatic control mode, movement of the boom and/or bucket is controlled based at least in part on the specified target mainfall, the specified target cross-slope, and the specified target elevation In another exemplary aspect according to the above-referenced method embodiment and optional aspects thereof, detection of the specified work state is based on a comparison of a received sequence of user inputs via the first interface tool and input signals from one or more onboard sensors with respect to stored sequences of user inputs and input data associated with the one or more onboard sensors and classified into different predetermined work states.

In another exemplary aspect according to the above-referenced method embodiment and optional aspects thereof, the onboard sensors comprise inertial measurement units positioned on the at least one implement.

In another exemplary aspect according to the above-referenced method embodiment and optional aspects thereof, the target surface mainfall and the target surface cross-slope are specified at least in part upon receiving, via a laser receiver associated with the machine and responsive to movement thereof, a laser reference transmitted from an external laser source.

In another exemplary aspect according to the above-referenced method embodiment and optional aspects thereof, the target surface mainfall and the target surface cross-slope are specified at least in part based on user inputs via at least a third user interface tool.

In another embodiment as disclosed herein, a work machine may include a machine frame, at least one implement for working a terrain, at least a first user interface tool configured to receive user inputs commanding movements of the at least one implement relative to the machine frame, and a second user interface tool configured to receive user inputs switching between a manual control mode and an automatic control mode. A controller is functionally linked to each of the at least first user interface tool, the second interface tool, and one or more actuators relating to the commanded movements of the at least one implement relative to the machine frame, and configured to direct the performance of steps according to the above-referenced method embodiment and optional aspects thereof.

Numerous objects, features, and advantages of the embodiments set forth herein will be readily apparent to those skilled in the art upon reading of the following disclosure when taken in conjunction with the accompanying drawings.

DETAILED DESCRIPTION

Figure 1:
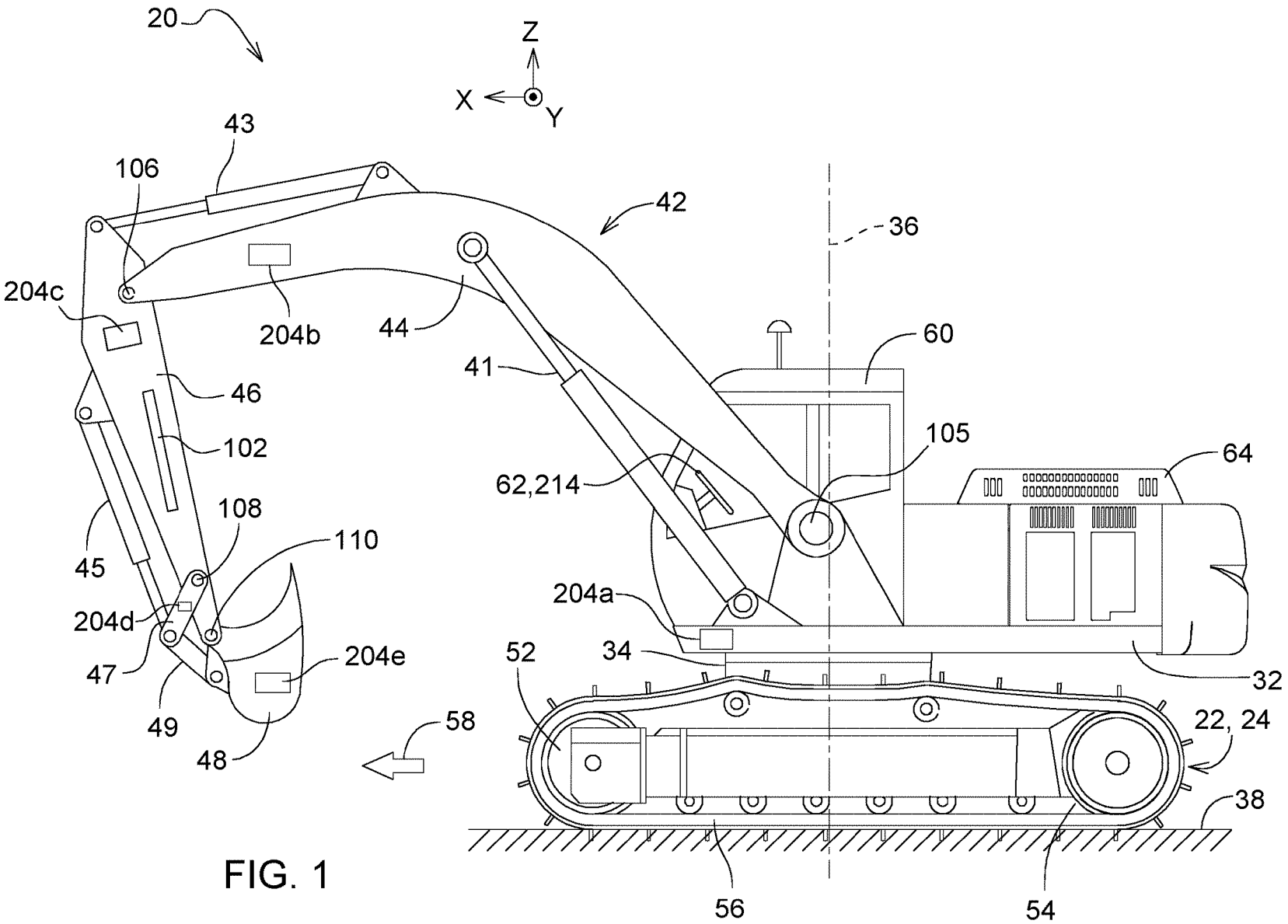
FIG. 1 is a side view representing an excavator as an exemplary work machine according to an embodiment of the present disclosure.

FIG. 1 depicts a representative self-propelled work machine 20 in the form of, for example, a tracked excavator machine but other suitable work machines for working terrain may fall within the scope of the present disclosure unless otherwise stated. The work machine 20 includes an undercarriage 22 with first and second ground engaging units 24 and further including first and second travel motors (not shown) for driving the first and second ground engaging units 24, respectively. A main frame 32 is supported from the undercarriage 22 by a swing bearing 34 such that the main frame 32 is pivotable about a pivot axis 36 relative to the undercarriage 22. The pivot axis 36 is substantially vertical when a ground surface 38 engaged by the ground engaging units 24 is substantially horizontal. A swing motor (not shown) is configured to pivot the main frame 32 on the swing bearing 34 about the pivot axis 36 relative to the undercarriage 22.

In an embodiment, a swing angle sensor (not shown) may include an upper sensor part mounted on the main frame 32 and a lower sensor part mounted on the undercarriage 22. Such a swing angle sensor may be configured to provide a swing (or pivot) angle signal corresponding to a pivot position of the main frame 32 relative to the undercarriage 22 about the pivot axis 36. The swing angle sensor may for example be a Hall Effect rotational sensor including a Hall element, a rotating shaft, and a magnet, wherein as the angular position of the Hall element changes, the corresponding changes in the magnetic field result in a linear change in output voltage. Other suitable types of rotary position sensors include rotary potentiometers, resolvers, optical encoders, inductive sensors, and the like.

A work implement 42 in the context of the referenced work machine 20 is a boom assembly having numerous components in the form of a boom 44 pivotably connected to the main frame 32 at a linkage joint 105, an arm 46 pivotally connected to the boom 44 at a linkage joint 106, and a working tool 48. The boom 44 is pivotally attached to the main frame 32 to pivot about a generally horizontal axis relative to the main frame 32. The working tool 48 in this embodiment is an excavator shovel, which is pivotally connected to the arm 46 at a linkage joint 110. One end of a dogbone 47 is pivotally connected to the arm 46 at a linkage joint, and another end of the dogbone 47 is pivotally connected to a tool link 49. A tool link 49 in the context of the referenced work machine 20 is a bucket link 49.

The boom assembly 42 extends from the main frame 32 along a working direction of the boom assembly 42. The working direction can also be described as a working direction of the boom 44. As described herein, control of the work implement 42 may relate to control of any one or more of the associated components (e.g., boom 44, arm 46, tool 48).

The first and second ground engaging units 24 as illustrated in FIG. 1 are tracked ground engaging units, but in various embodiments (not shown) may be wheels. Each of the tracked ground engaging units 24 includes a front idler 52, a drive sprocket 54, and a track chain 56 extending around the front idler 52 and the drive sprocket 54. The travel motor of each tracked ground engaging unit 24 drives its respective drive sprocket 54. Each tracked ground engaging unit 24 has a forward traveling direction 58 defined from the drive sprocket 54 toward the front idler 52. The forward traveling direction 58 of the tracked ground engaging units 24 also defines a forward traveling direction 58 of the undercarriage 22 and thus of the work machine 20.

An operator's cab 60 may be located on the main frame 32. The operator's cab 60 and the boom assembly 42 may both be mounted on the main frame 32 so that the operator's cab 60 faces in the working direction 58 of the boom assembly. A control station 62 may be located in the operator's cab 60.

Also mounted on the main frame 32 is an engine 64 for powering the working machine 20. The engine 64 may be a diesel internal combustion engine. The engine 64 may drive a hydraulic pump to provide hydraulic power to the various operating systems of the work machine 20.

Figure 2:
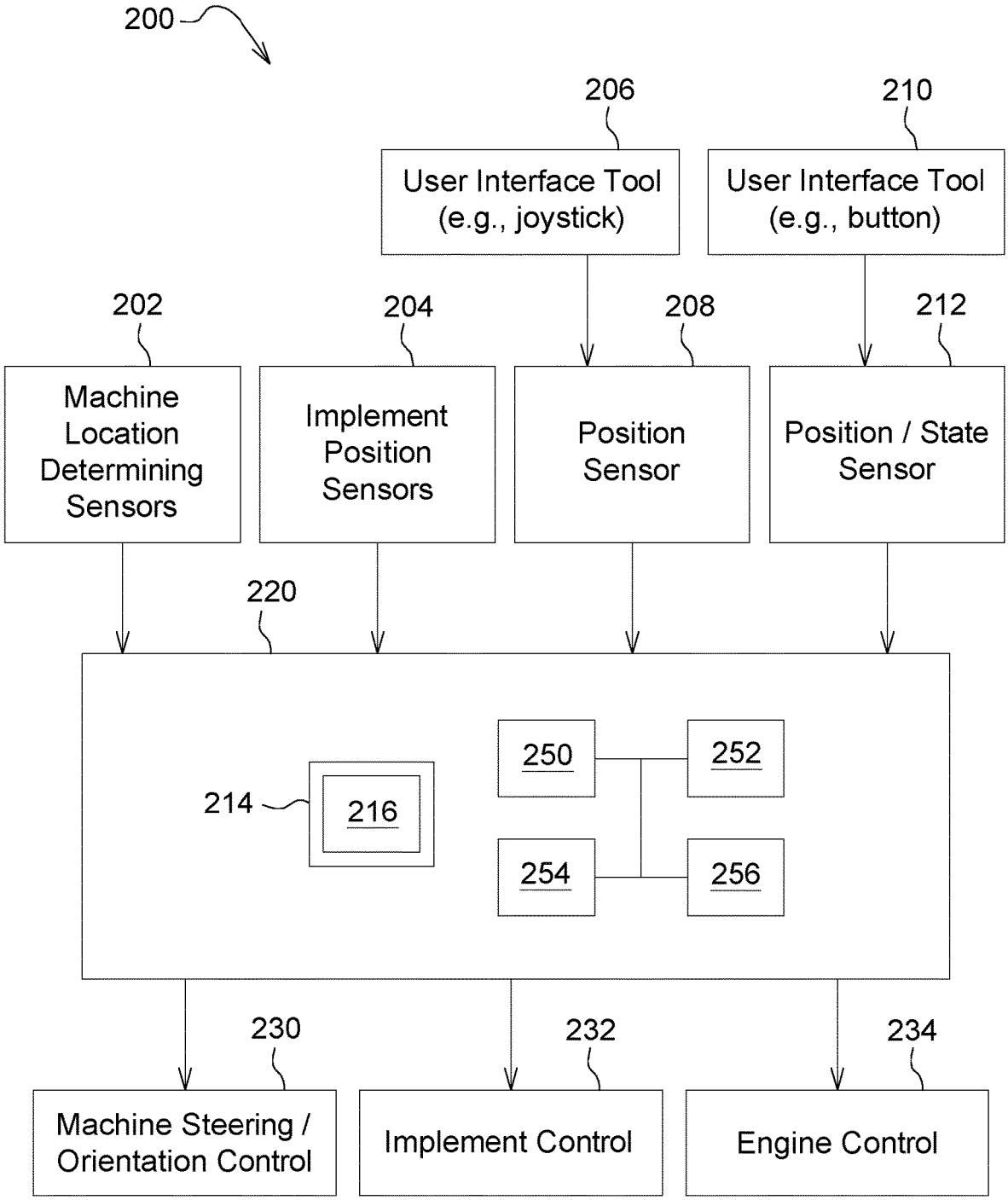
FIG. 2 is a block diagram representing an exemplary control system according to an embodiment of the present disclosure.

As schematically illustrated in FIG. 2, the work machine 20 may include a control system 200 including a controller 220. The controller 220 may be part of the machine control system of the working machine, or it may be a separate control module. The controller 220 may include a user interface 214 and optionally be mounted in the operator's cab 60 at the control station 62.

The controller 220 is configured to receive input signals from some or all of sensors 202, 204, 206, 208 as further described below. Various of the sensors 202, 204, 206, 208 may typically be discrete in nature, but signals representative of more than one input parameter may be provided from the same sensor, and a sensor system 202, 204, 206, 208 as disclosed herein may further include or otherwise refer to signals provided from the machine control system.

In an embodiment machine location determining sensors 202 may include a global positioning system (GPS) transceiver. Machine location determining sensors 202 may additionally or in the alternative include for example ground speed sensors, steering sensors, or the like, or equivalent inputs from the machine control system.

Work implement position sensors 204 in an embodiment as represented in FIG. 1 may include a set of inertial navigation system (INS) sensors mounted on the work machine 20, as represented generally including multiple sensors 204*a*, 204*b*, 204*c*, 204*d*, 104*e* respectively mounted to the main frame 32, the boom 44, the arm 46, the dogbone 47, and the tool 48. Alternative embodiments of work implement position sensors 204 may include rotary pin encoders mounted at pivot pins to detect the relative rotational positions of the respective components, linear encoders mounted on hydraulic cylinders to detect the respective extensions thereof, and the like.

In the embodiment represented in FIG. 1, which is intended as illustrative and non-limiting unless otherwise specifically noted herein, work implement position sensors 204 may include a sensor 204*a* mounted on the main frame 32; a sensor 204*b* mounted on the boom 44; a sensor 204*c* mounted on the arm 46; a sensor 204*d* mounted on the dogbone 47; and a sensor 204*e* mounted on the tool 48. Respective sensors may for example be mounted on opposing sides of at least one linkage joint. An opposing side of the at least one linkage joint may be ascertained by mounting or affixation of the work implement position sensors 204 on either side of the at least one linkage joint, which is defined as a pivotal linkage joint connecting the one or more components of the work implement 42.

For example, the at least one linkage joint may be defined at a linkage joint 106, which constitutes a pivotal connection of the boom 44 and the arm 46. In this example, the work implement position sensors 204 may be mounted in such a manner that the opposing sides of the at least one linkage joint are defined as follows: the sensor 204*b* mounted on the boom 44 opposing the sensor 204*c* mounted on the arm 46; the sensor 204*b* mounted on the boom 44 opposing the sensor 204*d* mounted on the dogbone 47; or the sensor 204*b* mounted on the boom 44 opposing the sensor 204*e* mounted on the tool 48.

As a further example, the at least one linkage joint may be defined at a pivotal connection of the arm 46 to the dogbone 47. In this example, the work implement position sensors 204 may be mounted in such a manner that the opposing sides of the at least one linkage joint are defined as follows: the sensor 204*c* mounted on the arm 46 opposing the sensor 204*d* mounted on the dogbone 47; the sensor 204*c* mounted on the arm 46 opposing the sensor 204*e* mounted on the tool 48; the sensor 204*b* mounted on the boom 44 opposing the sensor 204*d* mounted on the dogbone 47; or the sensor 204*b* mounted on the boom 44 opposing the sensor 204*e* mounted on the tool 48.

As a further example, the at least one linkage joint may be defined at a linkage joint 110, which constitutes a pivotal connection between the arm 46 and the tool 48. In this example, the work implement position sensors 204 may be mounted in such a manner that the opposing sides of the at least one linkage joint are defined as follows: the sensor 204*d* mounted on the dogbone 47 opposing the sensor 204*e* mounted on the tool 48; the sensor 204*c* mounted on the arm 46 opposing the sensor 204*e* mounted on the tool 48; or the sensor 204*b* mounted on the boom 44 opposing the sensor 204*e* mounted on the tool 48.

The work implement position sensors 204 may be oriented in an x-, y-, and z-axis coordinate system. Using as one example the sensor 204*c* as mounted on the arm 46 and the sensor 204*d* as mounted on the dogbone 47, respective body frames of the work implement position sensors 204*c* and 204*d* (not shown) may be mounted such that the x-axes of the aforementioned body frames point along the direction of the work implement 42. Alternatively, the body frame of the sensor 204*c* and the body frame of the sensor 204*d* may be mounted in a manner such that the z-axes of the aforementioned body frames point in the direction of the main frame 32 of the work machine 20 (i.e., the excavator). Because an x-, y-, and z-axis coordinate system may be defined arbitrarily, the foregoing are not intended as limiting. The x-, y-, and z-axis axis coordinate system, though it may be defined arbitrarily, relates to the mechanical axes of rotation for roll (i.e., rotation about the x-axis), pitch (i.e., rotation about the y-axis), and yaw (i.e., rotation about the z-axis).

Some or all of the work implement position sensors 204 in the context of the referenced work machine 20 may include inertial measurement units (each, an IMU). IMUs are tools that capture a variety of motion- and position-based measurements, including, but not limited to, velocity, acceleration, angular velocity, and angular acceleration.

IMUs may include a number of sensors including, but not limited to, accelerometers, which measure (among other things) velocity and acceleration, gyroscopes, which measure (among other things) angular velocity and angular acceleration, and magnetometers, which measure (among other things) strength and direction of a magnetic field. Generally, an accelerometer provides measurements, with respect to (among other things) force due to gravity, while a gyroscope provides measurements, with respect to (among other things) rigid body motion. The magnetometer provides measurements of the strength and the direction of the magnetic field, with respect to (among other things) known internal constants, or with respect to a known, accurately measured magnetic field. The magnetometer provides measurements of a magnetic field to yield information on positional, or angular, orientation of the IMU; similarly to that of the magnetometer, the gyroscope yields information on a positional, or angular, orientation of the IMU. Accordingly, the magnetometer may be used in lieu of the gyroscope, or in combination with the gyroscope, and complementary to the accelerometer, in order to produce local information and coordinates on the position, motion, and orientation of the IMU.

As conventionally known in the art, an accelerometer is an electro-mechanical device or tool used to measure acceleration ($m/s^2$), which is defined as the rate of change of velocity (m/s) of an object. Accelerometers sense either static forces (e.g., gravity) or dynamic forces of acceleration (e.g., vibration and movement). An accelerometer may receive sense elements measuring the force due to gravity. By measuring the quantity of static acceleration due to gravity of the Earth, an accelerometer may provide data as to the angle the object is tilted with respect to the Earth, the angle of which may be established in an x-, y-, and z-axis coordinate frame. However, where the object is accelerating in a particular direction, such that the acceleration is dynamic (as opposed to static), the accelerometer produces data which does not effectively distinguish the dynamic forces of motion from the force due to gravity by the Earth. Also as conventionally known in the art, a gyroscope is a device used to measure changes in orientation, based upon the object's angular velocity (rad/s) or angular acceleration ($rad/s^2$). A gyroscope may constitute a mechanical gyroscope, a micro-electro-mechanical system (MEMS) gyroscope, a ring laser gyroscope, a fiber-optic gyroscope, and/or other gyroscopes as are known in the art. Principally, a gyroscope is employed to measure changes in angular position of an object in motion, the angular position of which may be established in an x-, y-, and z-axis coordinate frame.

In an embodiment, for each of at least one linkage joint as referenced above, sense elements from the received work implement position sensor output signals may be fused in an independent coordinate frame associated at least in part with the respective linkage joint, the independent coordinate frame of which is independent of a global navigation frame for the work machine 20, wherein for example measurements received by work implement position sensors 204 may be merged to produce a desired output in the work implement 42 of the work machine 20.

As illustrated in FIG. 2, a user interface tool 206 such as a joystick 206 may for example be provided in the operator's cab 60 and in association with the control station 62. The Joystick 206 as conventionally known in the art may be configured, at least during manual control modes as further discussed below, to adjust a velocity and direction (e.g., a forward/reverse stroke pattern or sequence) of the work implement 42 during execution by the controller 220 of the motion sequence of the work implement 42 or components thereof. Movements of the joystick 206 may be monitored by a position sensor 208, such as a potentiometer, which generates output signals representing a position of the joystick 206, for example relative to a neutral position, to the controller 220.

Another user interface tool 210 such as a lever, switch, or button 210 (or even a second joystick) may also for example be provided in the operator's cab 60 and in association with the control station 62. User engagement of the second user interface tool 210 may be monitored by a position sensor 212 which generates output signals representing a state of the user interface tool 210 to the controller 220. The user interface tool 210 may for example define a control mode (e.g., manual, automatic) or otherwise disable operation of one or more work machine functions based on user actuation thereof.

In various embodiments, the user interface tool 206 and the user interface tool 210 may be integrated such that, for example, movements of the joystick 206 and user engagement of button 210 can be implemented using the same hand of an operator in the operator's cab 60. However, in other embodiments the user interface tool 206 and the user interface tool 210 may be discrete in nature and even disposed on opposing sides of the operator so that each hand of the operator is used to operate a respective user interface tool 206, 210.

In an embodiment, the operator may be enabled to define a longitudinal slope (mainfall) target setting and a lateral slope (cross-slope) target setting via the user interface 214. These settings, together with an elevation target setting as further discussed below, may define a target surface profile, the target surface profile further corresponding to an amount of material to be graded away from an initial or current surface profile. It may be understood that alternative target profile parameters, whether geometric, geographical, or the like, may be utilized within the scope of the present disclosure and as may for example reasonably be applied for a given type of work machine, terrain characteristics, work cycle, environmental conditions, or the like.

The controller 220 may be configured to produce outputs, as further described below, to a user interface 214 for display to the human operator or other appropriate user. The controller 220 may be configured to receive inputs from the user interface 214, such as user input provided via the user interface 214. Not specifically represented in FIG. 2, the controller 220 of the work machine 20 may in some embodiments further receive inputs from and generate outputs to remote devices associated with a user via a respective user interface, for example a display unit with touchscreen interface. Data transmission between for example a vehicle control system and a remote user interface may take the form of a wireless communications system and associated components as are conventionally known in the art. In certain embodiments, a remote user interface and vehicle control systems for respective work machines 20 may be further coordinated or otherwise interact with a remote server or other computing device for the performance of operations in a system as disclosed herein.

The controller 220 may further, or in the alternative, be configured to generate control signals for controlling the operation of respective actuators, or signals for indirect control via intermediate control units, associated with a machine steering control system 230, a machine implement control system 232, and/or an engine speed control system 234. The control systems 230, 232, 234 may be independent or otherwise integrated together or as part of a machine control unit in various manners as known in the art. The controller 220 may, for example, generate control signals for controlling the operation of various actuators, such as hydraulic motors or hydraulic piston-cylinder units 41, 43, 45, and electronic control signals from the controller 220 may actually be received by electro-hydraulic control valves associated with the actuators such that the electro-hydraulic control valves will control the flow of hydraulic fluid to and from the respective hydraulic actuators to control the actuation thereof in response to the control signal from the controller 220. In an embodiment, the controller 220 may in the context of a control operation further receive a pivot angle signal from a pivot angle sensor as described above and selectively drive a swing motor automatically to rotate the main frame 32 about the pivot axis 36 relative to the undercarriage 22 to a target pivot position of the main frame 32 relative to the undercarriage 22, as part of an aforementioned control unit 230, 232, 234 or optionally as a separate and/or integrated control unit within the scope of the present disclosure.

The controller 220 may include, or be associated with, a processor 250, a computer readable medium 252, a communication unit 254, data storage 256 such as for example a database network, and the aforementioned user interface 214 or control panel having a display 216. An input/output device, such as a keyboard, touch screen, or other user interface tool may be coupled to the controller 220 via the user interface 214 so that the human operator may input instructions to the controller 220.

It is understood that the controller 220 described herein may be a single controller having all of the described functionality, or it may include multiple controllers wherein the described functionality is distributed among the multiple controllers.

Various "computer-implemented" operations, steps or algorithms as described in connection with the controller 220 or alternative but equivalent computing devices or systems can be embodied directly in hardware, in a computer program product such as a software module executed by the processor 250, or in a combination of the two. The computer program product can reside in RAM memory, flash memory, ROM memory, EPROM memory, EEPROM memory, registers, hard disk, a removable disk, or any other form of computer-readable medium 252 known in the art. An exemplary computer-readable medium 252 can be coupled to the processor 250 such that the processor 250 can read information from, and write information to, the memory/storage medium 252. In the alternative, the medium 252 can be integral to the processor 250. The processor 250 and the medium 252 can reside in an application specific integrated circuit (ASIC). The ASIC can reside in a user terminal. In the alternative, the processor 250 and the medium 252 can reside as discrete components in a user terminal.

The term "processor" 250 as used herein may refer to at least general-purpose or specific-purpose processing devices and/or logic as may be understood by one of skill in the art, including but not limited to a microprocessor, a microcontroller, a state machine, and the like. A processor 250 can also be implemented as a combination of computing devices, e.g., a combination of a digital signal processor (DSP) and a microprocessor, a plurality of microprocessors, one or more microprocessors in conjunction with a DSP core, or any other such configuration.

The communication unit 254 may support or provide communications between the controller 220 and external systems or devices, and/or support or provide communication interface with respect to internal components of the self-propelled work machine 20. The communications unit 254 may include wireless communication system components (e.g., via cellular modem, WiFi, Bluetooth, or the like) and/or may include one or more wired communications terminals such as universal serial bus ports.

The data storage 256 as further described below may, unless otherwise stated, generally encompass hardware such as volatile or non-volatile storage devices, drives, memory, or other storage media, as well as one or more databases residing thereon.

Figure 3:
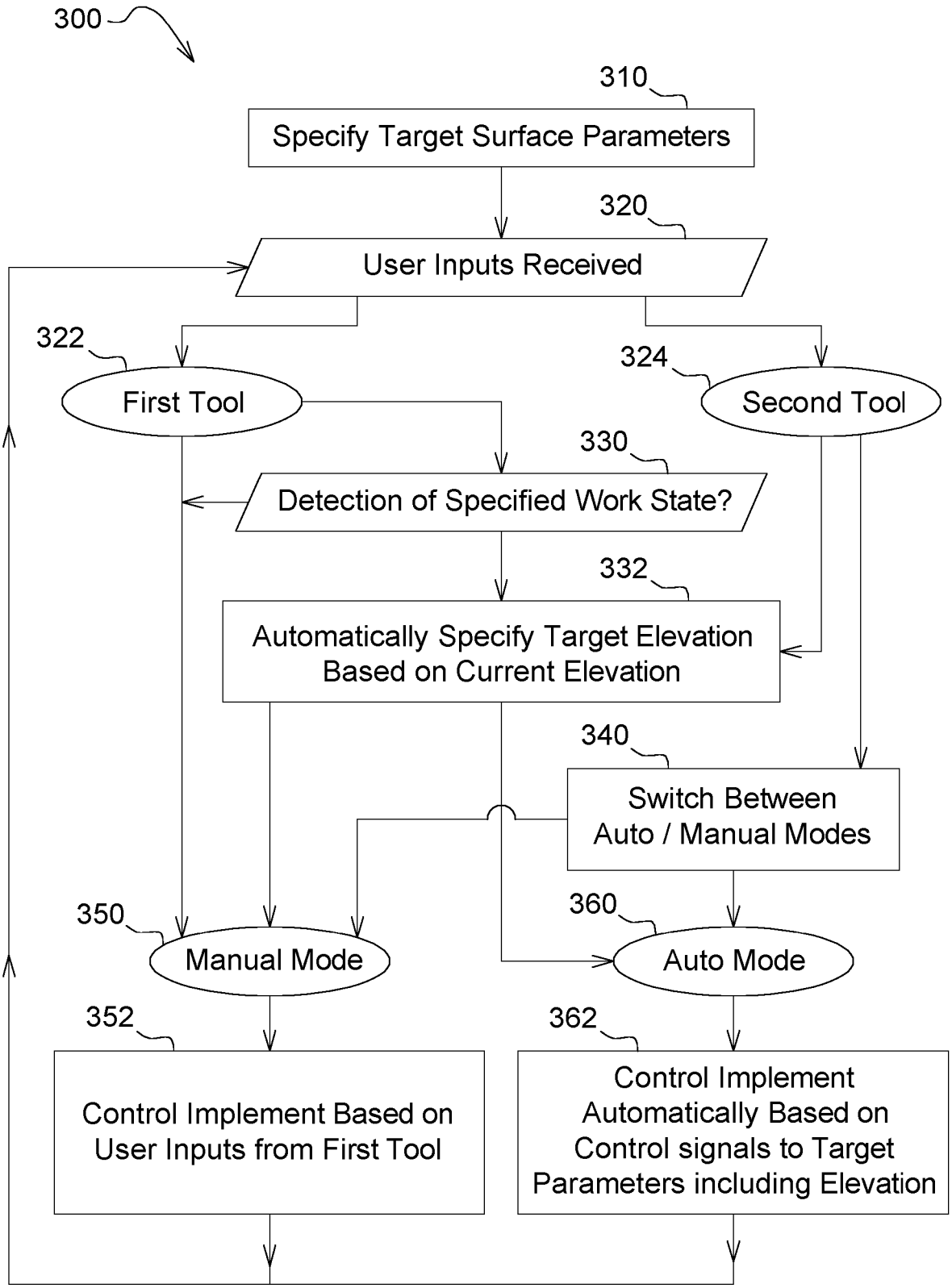
FIG. 3 is a flowchart representing an exemplary embodiment of a method as disclosed herein.

In FIG. 3, the depicted flowchart represents an exemplary embodiment of a method 300 for controlling movements (e.g., associated with grading operations) of one or more work implements 42 for a work machine 20 such as an excavator, the work implement 42 of which includes one or more components coupled to a main frame 32 of the work machine 20. In the context of the exemplary work implement 42 of the work machine 20 depicted in FIG. 1, the one or more components may include a boom 44, an arm 46, and an earth working tool 48 such as a bucket.

The illustrated method 300 includes a first step 310 of specifying target surface parameters, for example including at least a target surface mainfall and a target cross-slope for at least a portion of a terrain to be worked. As noted above, in an embodiment values for the mainfall and cross-slope parameters may be provided by an operator via the user interface 214, but in other embodiments the target surface profile and associated values may otherwise be obtained from a predetermined map, carried over from a previous work cycle, provided in automated or semi-automated form using a laser receiver, and the like.

The method in step 320 as illustrated in FIG. 3 may continue by receiving user inputs from one or more user interface tools 206, 210, for example via respective sensors 208, 212, and performing corresponding actions. In an embodiment this may include, upon receiving user inputs from a first user interface tool 206 such as a joystick (step 322), and further during a manual control mode (step 350), controllably actuating movements of the work implement 42 relative to the machine frame 32 based at least in part thereon. Other corresponding actions may include, upon receiving user inputs from a second user interface tool 210 such as a button (step 324), which may be integrated with the joystick itself, selectively switching between the manual control mode and an automatic control mode based at least in part thereon (step 340).

In addition to the above-referenced steps, the method 300 may further include steps of detecting a specified work state (step 330), or a transition to or from the specified work state, for example based on detected or predicted movements of the work implement 42 corresponding to the user input via the first interface tool 206, and automatically specifying a target elevation responsive to a predetermined user input or sequence of user inputs via the first user interface tool 206 and/or the second user interface tool 210 (step 332). As noted elsewhere herein, the target elevation may be specified as corresponding to a current elevation of the bucket 49 or more particularly a specified portion thereof, at the time of the predetermined user input or sequence of user inputs via the first user interface tool 206 and/or the second user interface tool 210. However, it may be understood that the specified target elevation may be based on the current elevation of other work machine components, or as offset from a current elevation based on for example a predetermined offset value, or the like.

During the automatic control mode (step 360), movement of the work implement 42 and optionally other components of the work machine 20 may further be controlled in step 362 based at least in part on specified target profile values including the target mainfall, the specified target cross-slope, and the specified target elevation.

In one example, the specified work state may be detected as corresponding to a grading operation and further in view of recognized user inputs commanding the work implement. Upon recognizing the work state and corresponding movements as an intent to specify a target elevation, such a parameter is specified based on the current (reference)

elevation of for example the ground engaging surface of the bucket 49, such as the bucket tooth tip thereof, wherein the boom and/or bucket are controlled to maintain the desired grade surface from that target (reference) elevation. In other words, an auto-benching step may be performed in this example when the arm has been commanded in and the boom no longer has any user (operator) input while in or transitioning from a specified (e.g., digging) work state. As but one alternative within the scope of the present disclosure, an auto-benching step may be performed responsive to user input from the operator comprising engagement of the second user interface tool (e.g., pressing the "auto" button) in a press-and-hold button in association with a grade control method.

In an embodiment, the work state detection step 330 may encompass the classifying of sequences of data recorded by one or more sensors 202, 204, 208, 212) as being correlated with specific work states from a second data set. The method step 330 accordingly may include receiving current inputs from sensors 202, 204, 206, and 208 (and optionally other sensors or data sources associated with the work machine) and comparing the current sensor inputs alone or in combination with respect to stored combinations and/or sequences comprising the first group of data sets for classifying a current work state.

Referring to an example wherein an excavator is used as the work machine 20, an exemplary sequence of work states may include Dig, Swing, Dump, Adjust to Dump, and Travel. Work state estimation may be treated a classical sequence classification problem, addressed for example by building supervised Machine Learning (ML)/Deep Learning (DL) classification algorithms like Logistic Regression and Long Short-Term Memory (LSTM) recurrent neural network models for sequence classification. The LSTM models are capable of learning from internal representations of the time series data, effectively remembering over long sequences of input data and previous operation of the work machine 20. The LSTM models may accordingly be trained on time series data (exemplary inputs as noted above) and observe loss and accuracy values over N training iterations, wherein losses are decreased and accuracy increased over time. The model may be described as classifying these time series data into defined work states.

For generation of the model, time series data may for example be streamed from the respective sensors/data sources 202, 204, 206, 208, 210, 212 on a work machine 20 (or a plurality of analogous work machines) via a communications network onto a cloud server network, wherein the model is developed (i.e., trained and validated) at the cloud server level. Once the model has been sufficiently validated, it may be transmitted, for example via the communications network, and deployed by the controller 220 onboard a work machine 20 for subsequent work state estimation/detection. The cloud server network may however continue to receive input time series data from the work machine 20 (or plurality of analogous work machines) for the purpose of further refining the model, wherein updated versions of the model may be transmitted to the work machine 20 periodically or on demand.

In an embodiment, the target surface profile may be determined in a work machine coordinate system. In other embodiments within the scope of the present disclosure, a position of the work machine 20 and the target surface profile parameters may be determined in a target surface coordinate system. In either example, the grade control system may reliably direct control of a grading operation in accordance with the determined target surface profile, wherein for example movement of the work machine 20 and/or one or more work implement components is controlled or directed based at least in part on the determined target surface profile and further in view of monitored positions and/or movements of the work implement 42. The monitored positions may include at least one joint characteristic, such as a joint angle, for a respective linkage joint. The controller 220 may be configured to automatically control movement of the one or more work implements of the boom assembly 42 of the work machine 20, via one or more of a steering control unit 230, a swing angle or equivalent implement control unit 234, and an engine speed control unit 234. The human operator may effectuate movement or direction of the ground engaging units 24 and/or one or more work implements 42 by or through the user interface tools 206, 210 and/or the user interface 214. The controller 220 may, for example, generate control signals for controlling the operation of various actuators, such as hydraulic motors or hydraulic piston-cylinder units 41, 43, and 45, as depicted in FIG. 1.

As used herein, the phrase "one or more of," when used with a list of items, means that different combinations of one or more of the items may be used and only one of each item in the list may be needed. For example, "one or more of" item A, item B, and item C may include, for example, without limitation, item A or item A and item B. This example also may include item A, item B, and item C, or item Band item C.

Thus, it is seen that the apparatus and methods of the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims. Each disclosed feature or embodiment may be combined with any of the other disclosed features or embodiments.

What is claimed is:

1. A method of operating a work machine comprising a machine frame and at least one implement for working a terrain, the method comprising:

specifying at least a target surface mainfall and a target cross-slope for at least a portion of the terrain to be worked;

actuating movements of the at least one implement relative to the machine frame based at least in part on user inputs via a first user interface tool;

switching between a manual control mode and an automatic control mode based at least in part on user inputs via a second user interface tool;

detecting a specified work state for the work machine based on a comparison of received user inputs via the first interface tool with respect to stored combinations and/or sequences of user inputs via the first interface tool and classified into different predetermined work states;

responsive to a predetermined user input via at least one of the first and the second user interface tool and the detected work state, further automatically specifying a target elevation based on a current elevation of at least one component of the at least one implement corresponding to the predetermined user input; and during the automatic control mode, controlling movement of at least the at least one implement for working the terrain based at least in part on the specified target mainfall, the specified target cross-slope, and the specified target elevation.

2. The method of claim 1, wherein:

the specified work state corresponds to a digging work state;

the at least one implement comprises a boom, an arm, and a bucket; and the target elevation is specified responsive to a cessation of user input via the first user interface tool commanding the arm inward.

3. The method of claim 2, wherein during the automatic control mode, movement of the boom and/or bucket is controlled based at least in part on the specified target mainfall, the specified target cross-slope, and the specified target elevation.

4. The method of claim 1, wherein the target surface mainfall and the target surface cross-slope are specified at least in part upon receiving, via a laser receiver associated with the machine and responsive to movement thereof, a laser reference transmitted from an external laser source.

5. The method of claim 1, wherein the target surface mainfall and the target surface cross-slope are specified at least in part based on user inputs via at least a third user interface tool.

6. A work machine comprising:

a machine frame;

at least one implement supported from the machine frame and controllable in movement with respect thereto for working a terrain;

at least a first user interface tool configured to generate signals representative of user engagement thereof as user inputs commanding movements of the at least one implement relative to the machine frame;

a second user interface tool configured to generate signals representative of user engagement thereof as user inputs switching between a manual control mode and an automatic control mode; and a controller functionally linked to each of the at least first user interface tool, the second interface tool, and one or more actuators relating to the commanded movements of the at least one implement relative to the machine frame, the controller configured to:

detect a specified work state for the work machine based on a comparison of received user inputs via the first interface tool with respect to stored combinations and/or sequences of user inputs via the first interface tool and classified into different predetermined work states;

specify at least a target surface mainfall and a target cross-slope for at least a portion of the terrain to be worked;

responsive to the a predetermined user input via at least one of the first and the second user interface tool, further automatically specify a target elevation based on the detected work state and a current elevation of at least one component of the at least one implement corresponding to the further user input; and during the automatic control mode, control movement of at least the at least one implement for working the terrain based at least in part on the specified target mainfall, the specified target cross-slope, and the specified target elevation.

7. The work machine of claim 6, comprising an excavator and wherein:

the specified work state corresponds to a digging work state;

the at least one implement comprises a boom, an arm, and a bucket; and the target elevation is specified responsive to a cessation of user input via the first user interface tool commanding the arm inward.

8. The work machine of claim 7, wherein:

during the automatic control mode, movement of the boom and/or bucket is controlled based at least in part on the specified target mainfall, the specified target cross-slope, and the specified target elevation.

9. The work machine of claim 6, wherein:

the target surface mainfall and the target surface cross-slope are specified at least in part upon receiving, via a laser receiver associated with the machine and responsive to movement thereof, a laser reference transmitted from an external laser source.

10. The work machine of claim 6, wherein:

the target surface mainfall and the target surface cross-slope are specified at least in part based on user inputs via at least a third user interface tool.

11. A method of operating a work machine comprising a machine frame and at least one implement for working a terrain, the method comprising:

specifying at least a target surface mainfall and a target cross-slope for at least a portion of the terrain to be worked;

actuating movements of the at least one implement relative to the machine frame based at least in part on user inputs via a first user interface tool;

switching between a manual control mode and an automatic control mode based at least in part on user inputs via a second user interface tool;

detecting a specified work state for the work machine based on a comparison of a received sequence of user inputs via the first interface tool and input signals from one or more onboard sensors with respect to stored sequences of user inputs and input data associated with the one or more onboard sensors and classified into different predetermined work states;

responsive to a predetermined user input via at least one of the first and the second user interface tool and the detected work state, further automatically specifying a target elevation based on a current elevation of at least one component of the at least one implement corresponding to the further user input; and during the automatic control mode, controlling movement of at least the at least one implement for working the terrain based at least in part on the specified target mainfall, the specified target cross-slope, and the specified target elevation.

12. The method of claim 11, wherein the onboard sensors comprise inertial measurement units positioned on the at least one implement.

13. The method of claim 11, method of claim 1, wherein the target surface mainfall and the target surface cross-slope are specified at least in part upon receiving, via a laser receiver associated with the machine and responsive to movement thereof, a laser reference transmitted from an external laser source.

14. The method of claim 11, wherein the target surface mainfall and the target surface cross-slope are specified at least in part based on user inputs via at least a third user interface tool.

* * * * *